US008052386B1

(12) United States Patent
Fitzpatrick et al.

(10) Patent No.: US 8,052,386 B1
(45) Date of Patent: Nov. 8, 2011

(54) MIXED FLOW ROOF EXHAUST FAN

(75) Inventors: Erich R. Fitzpatrick, Strafford, MO (US); Rickey W. Jennings, Ozark, MO (US); Robert A. Valbracht, Springfield, MO (US)

(73) Assignee: Loren Cook Company, Springfield, MO (US)

( * ) Notice: Subject to any disclaimer, the term of this patent is extended or adjusted under 35 U.S.C. 154(b) by 104 days.

(21) Appl. No.: 12/655,348

(22) Filed: Dec. 29, 2009

Related U.S. Application Data

(63) Continuation of application No. 11/431,403, filed on May 10, 2006, now abandoned.

(60) Provisional application No. 60/682,306, filed on May 18, 2005.

(51) Int. Cl.
*F04D 29/28* (2006.01)

(52) U.S. Cl. ..... 415/218.1; 416/186 R; 416/188; 416/242

(58) Field of Classification Search ..... 415/211.2, 415/218.1, 219.1, 220, 223; 416/185, 186 R, 416/187, 188, 223 B, 238, 242; 454/341
See application file for complete search history.

(56) References Cited

U.S. PATENT DOCUMENTS

| | | | | | |
|---|---|---|---|---|---|
| 2,054,144 | A * | 9/1936 | Swigert | 416/186 R |
| 2,360,440 | A * | 10/1944 | Muller et al. | 416/188 |
| 2,774,293 | A * | 12/1956 | Jenn | 454/356 |
| 3,045,579 | A * | 7/1962 | Jenn et al. | 454/341 |
| 3,147,541 | A * | 9/1964 | Hathaway | 29/889.4 |
| 3,202,081 | A * | 8/1965 | Cook | 454/356 |
| 3,433,145 | A * | 3/1969 | Baker et al. | 454/352 |
| 7,048,499 | B2 * | 5/2006 | Mathson et al. | 415/119 |

* cited by examiner

*Primary Examiner* — Nathaniel Wiehe
(74) *Attorney, Agent, or Firm* — Jonathan A. Bay

(57) ABSTRACT

A mixed flow fan wheel has a convex hub, an axially-spaced away concave annular shroud, and a plurality of angularly distributed blades extending between and interconnecting the hub and shroud, all which cooperatively define a plurality of inter-blade flow channels. Each has a pressure surface and spaced suction surface extending not only between spaced inlet and discharge edges but also, crosswise thereto, spaced hub-side and shroud-side edges. Each discharge edge is convex relative a center of geometry of the blade therefor. Each inter-blade flow channel originates in a generally rectangular shape between flanking inlet edges and terminates in another generally rectangular shape between flanking discharge edges, with a procession of gradations of generally rectangular shapes forming a progressive transition therebetween. Moreover, each inter-blade flow channel twists or corkscrews from inlet thereof to the discharge.

9 Claims, 6 Drawing Sheets

MIXED FLOW ROOF EXHAUST FAN

CROSS-REFERENCE TO RELATED APPLICATION(S)

This application is a continuation of U.S. patent application Ser. No. 11/431,403, filed May 10, 2006 now abandoned, which claims the benefit of U.S. Provisional Application No. 60/682,306, filed May 18, 2005. The foregoing disclosures are incorporated herein by this reference thereto.

BACKGROUND AND SUMMARY OF THE INVENTION

The invention relates to mixed flow roof exhaust fans. A number of additional features and objects will be apparent in connection with the following discussion of the drawings and preferred embodiment(s) and example(s).

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the appended claims. In the drawings.

DETAILED DESCRIPTION OF THE PREFERRED EMBODIMENTS

Figure 1:
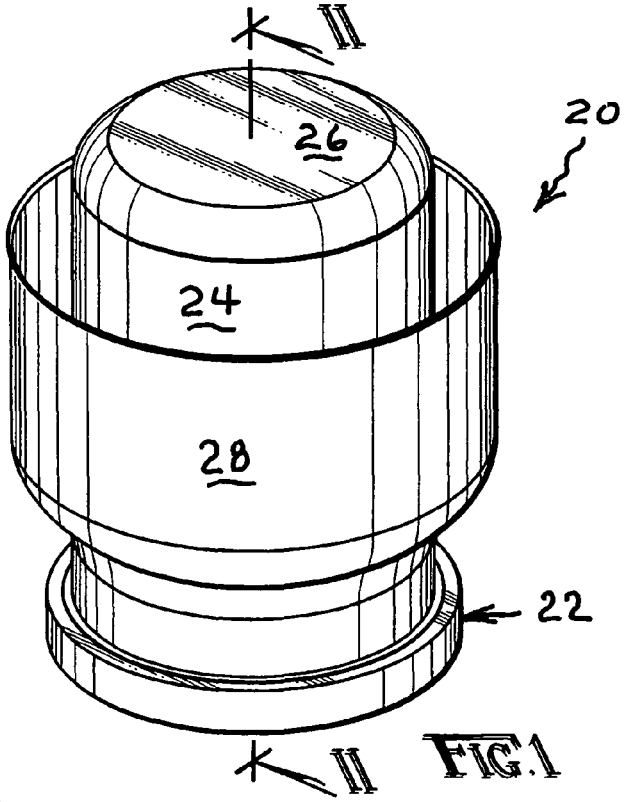
FIG. 1 is a perspective view of roof exhaust fan in accordance with the invention, comprising an upblast embodiment thereof.
Figure 2:
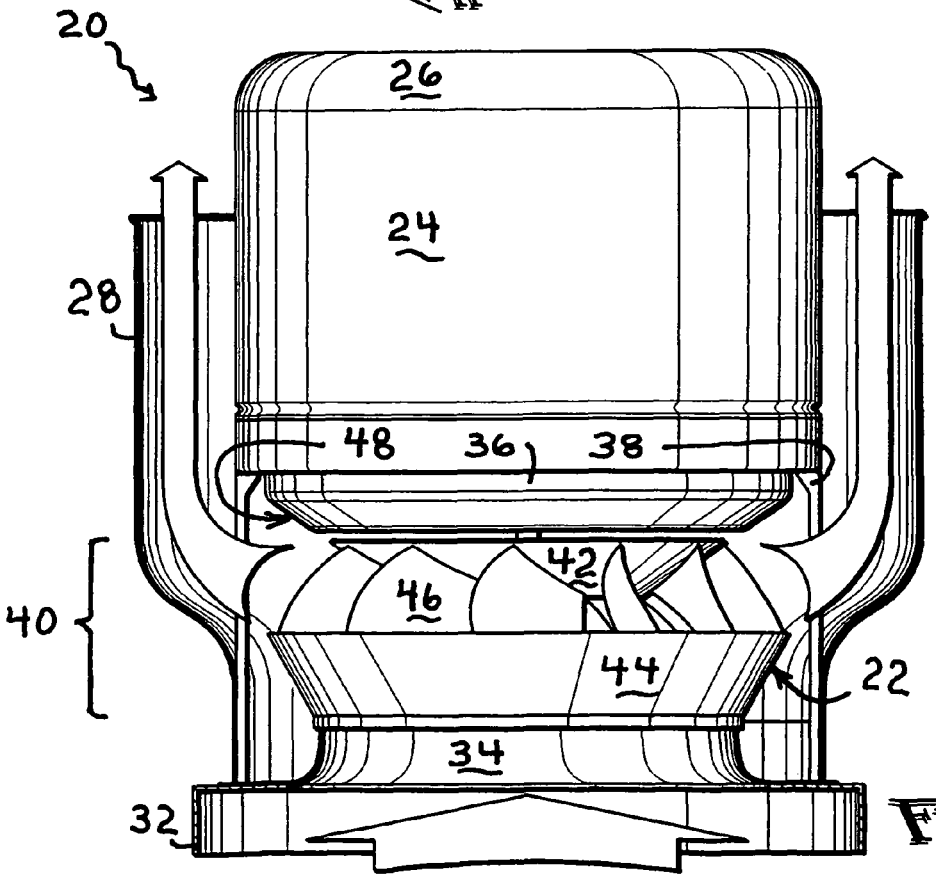
FIG. 2 is an enlarged scale partial sectional view taken along line II-II in FIG. 1.

FIGS. 1 and 2 show a roof exhaust fan 20 in accordance with the invention. This particular embodiment is arranged for upblast service. One aspect of the invention comprises its modularity. In this aspect, the fan 20 comprises a core package 22, a top cylinder and cap 24 and 26, and an outer band 28.

Figure 12:
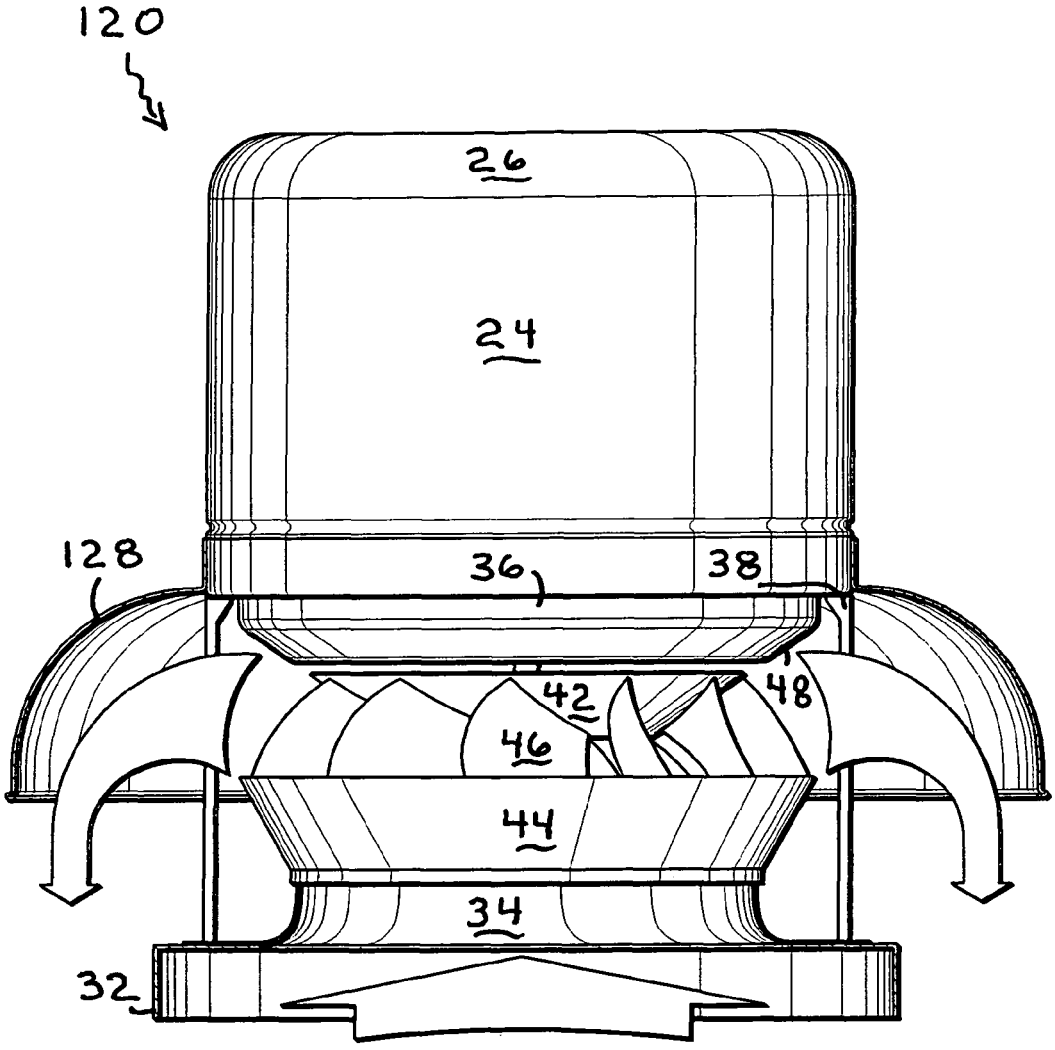
FIG. 12 is a partial sectional view comparable to FIG. 2 except showing a downblast embodiment in accordance with the invention.

During installation, preferably the core package 22 is mounted on the roof independent of and earlier than attachment of the top cylinder and cap 24 and 26 and outer band 28. After the core package 22 is seated and mounted, then preferably the top cylinder and cap 24 and 26 and outer band 28 are attached to it. One advantage of this modularity is shown by contrasting FIG. 2 against FIG. 12. To turn ahead to FIG. 12, it shows another embodiment of a roof exhaust fan 120 in accordance with the invention except arranged for downblast service. In FIG. 12, the core package 22 is the same as utilized in FIGS. 1 and 2. The distinguishing aspect of FIG. 12 is that the up-exhausting outer band 28 of FIG. 2 has been replaced with a down-exhausting outer band 128 as shown. Hence the same core package 22 is convertible for utilization in various fan arrangements, including without limitation upblast and downblast service.

In consequence, it is an aspect of the invention that the factory's production of the core package 22 is uniform regardless of whether the end-use is either upblast, downblast or other. The place and time where a particular end-use is determined for the core package 22 is when the other modular components of the fan are attached on the installation site. Indeed, this modular fan 20/120 accepts being converted from a preceding mode to a succeeding mode (eg., as from upblast mode to downblast mode) even after an extended service life in the preceding mode. As long as the core package 22 is functional, it allows conversion at any date.

Returning to FIG. 2, it shows that the core package 22 includes a stationary base 32 and baffle 34. The base 32 props up a stationary motor support plate 36 (motor not shown) by means of multiple posts 38 (only two shown). Suspended off the motor shaft (again, motor is not shown, neither is the shaft) is a rotational fan wheel 40.

The fan wheel 40 comprises an outlet-side hub 42, an inlet-side shroud 44, and a cascade of angularly-paced blades 46 that extend between and interconnect the shroud 44 with the hub 42.

The hub 42 has sort of a dish structure while the shroud 44 has a ring or band structure. To turn ahead to FIG. 7, it shows better that both the hub 42 and shroud 44 have slant surfaces in the form of, in more technical language, frustums of right circular cones. The hub 42 has a slant angle that is flatter or shallower than that of the shroud 44. The hub 42 and shroud 44 alike have major and minor bases (ie., the base with the larger diameter and the other with the smaller diameter, respectively). The hub 42's major base's diameter is smaller than that of the shroud 44's major base. Given the foregoing, the hub 42 and shroud 44 cooperatively determine the lateral boundaries of the flow passage through the wheel 40. Indeed, more particularly, the flow passage through the wheel 40 is furthermore chopped up by the cascade of blades 46, which define an angularly-spaced cascade of passageways, there being one such passageway between each adjacent pair of blades 46.

With the foregoing in mind, FIG. 2 (as well as FIG. 12) shows another aspect of the invention, and it concerns an outlet diffuser 48. This outlet diffuser 48 is produced directly in the motor support plate 36 in the form of a chamfer around the cylindrical bottom rim thereof. In the same technical language as used above, it is preferred if this outlet diffuser 48 is shaped as a frustum of a right circular cone. Whereas one non-limiting example of how to construct this diffuser 48 is shown as producing it directly in the lower margin of the motor support plate 36, other suitable ways are readily recognizable to ordinarily skilled persons in the art.

It is additionally preferred if the outlet diffuser 48 is shaped to have the same slant angle as the hub 42. It is more preferential still if the outlet diffuser 48's minor base is comparably the same size as and arranged to form nearly a seamless continuation of the hub 42's major base. That way, the outlet diffuser 48 forms nearly a seamless geometric continuation of transition from the geometry of the hub 42, except that instead of being rotating like the hub 42 the outlet diffuser 48 is stationary. It is believed that this outlet diffuser 48 in accordance with the invention reduces momentum losses with the air outputted by the wheel 40. It is not known if this loss-savings is obtained by reducing friction losses, expansion losses or whatever.

Referencing now FIGS. 3 through 11, these series views show various inventive aspects of the mixed flow fan wheel 40 in accordance with the invention. By way of background, mixed flow fans have impellers (in the instance here, it has a wheel construction) whose output is somewhere between being centrifugal outputted and axially outputted.

Figure 3:
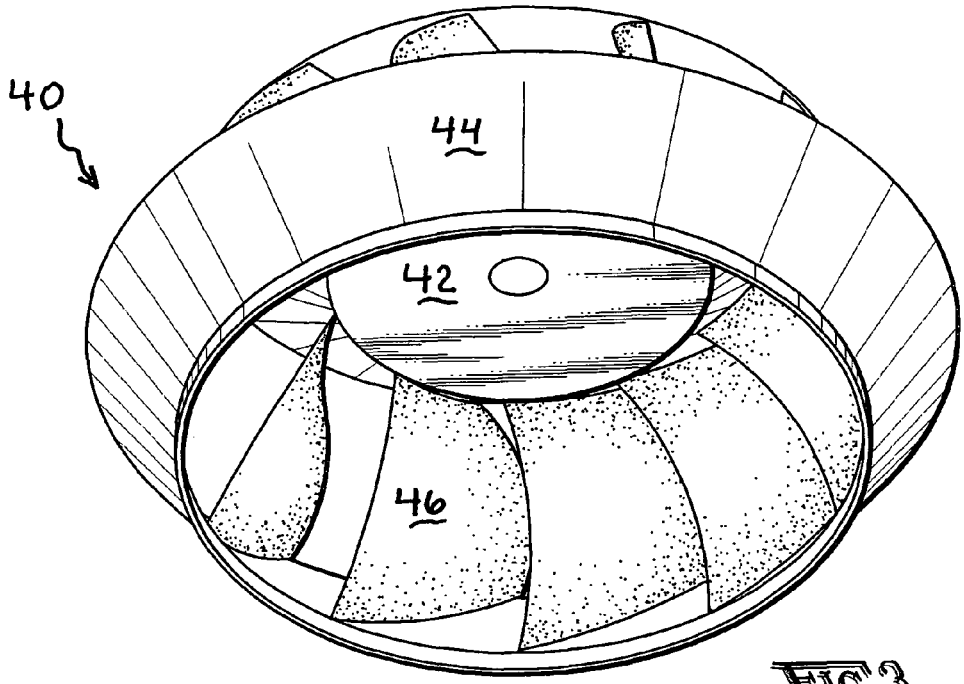
FIG. 3 is a bottom perspective view of the fan wheel in FIG. 2.
Figure 6:
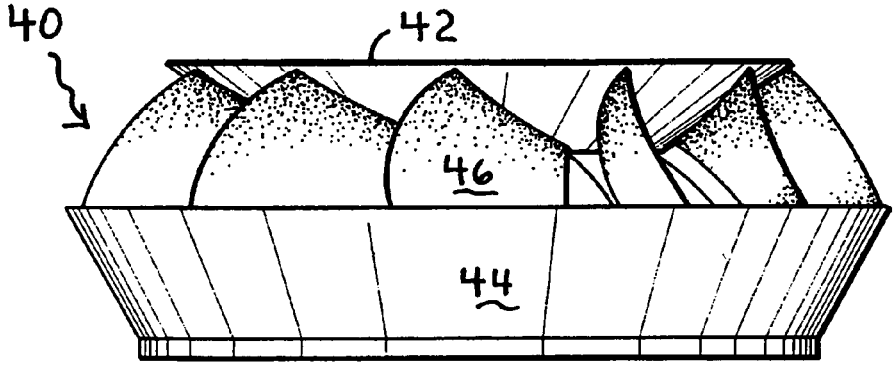
FIG. 6 is a side elevational view thereof.
Figure 7:
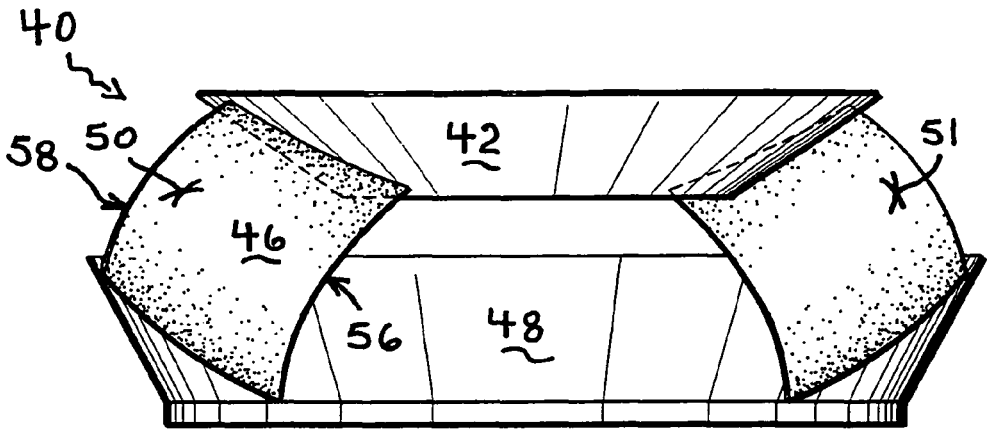
FIG. 7 is a sectional view taken along line VII-VII in FIG. 5 except all the blades of the wheel but two are removed from view for convenience for showing the mating of the shroud and hub edges thereof to the shroud and hub respectively.

This distinction can be reckoned another way. Here, this mixed flow impeller 40 in accordance with the invention has the wheel construction as shown, comprising the hub 42, the axially-spaced away shroud 44, and the cascade of angularly-spaced blades 46 distributed between and interconnecting the shroud 44 and hub 42. If the wheel 40 were inverted from how it is illustrated in FIG. 3 or 6, then the geometry of the hub 42 could be reckoned as an inverted dish, and the geometry of the shroud 44 as a lampshade situated relatively above and surrounding the hub 42. The shroud 44's open neck defines the inlet or intake for the wheel 40. Engineers, among others, are interested in rating such wheels 40 of mixed flow fans by various performance and/or geometry metrics. One such geometry metric that interests engineers is the ratio of the outer diameters of the hub 42 and shroud 44 respectively. Generally the ratio of hub to shroud diameter is less than 100%. Indeed, if the ratio approaches 100% (unity), then it is more accurate to say that the result is a centrifugal-flow impeller. Conversely, if the ratio approaches 0% (zero), then it is more accurate to say that the result is an axial-flow impeller (eg., a prop). Therefore, a mixed flow impeller has a hub to shroud size-ratio that is situated between those two extremes. FIG. 7 illustrates an example hub to shroud geometry that is preferred in accordance with the invention.

Figure 4:
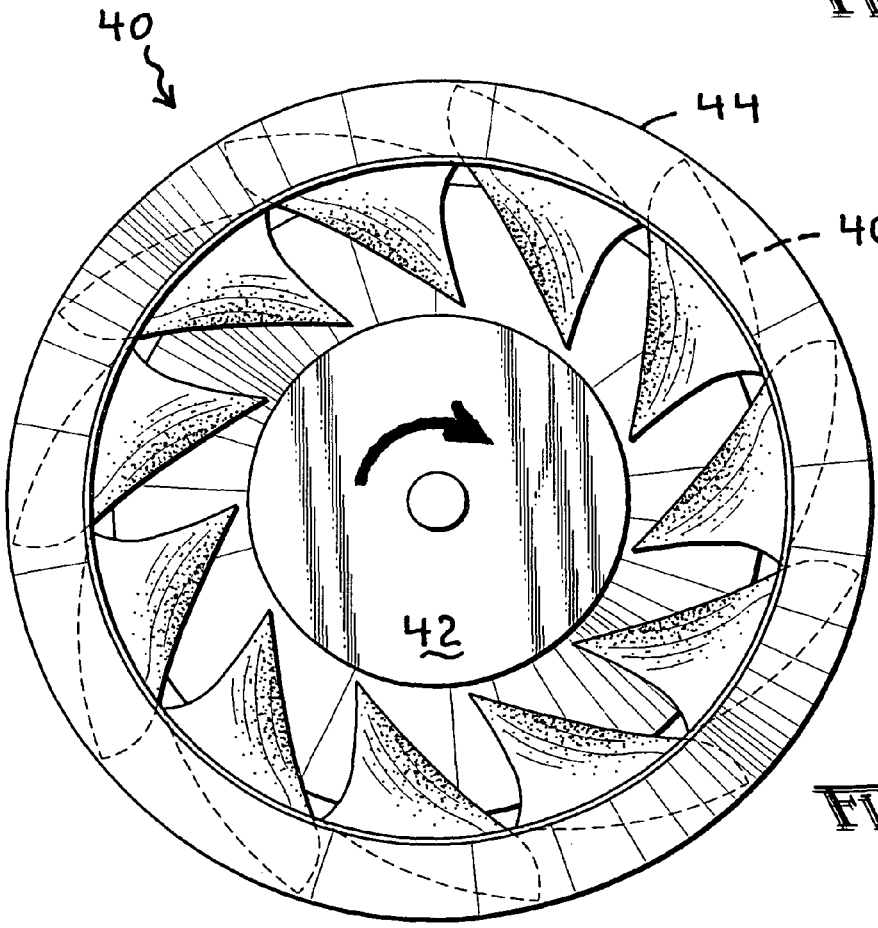
FIG. 4 is a bottom plan view thereof.
Figure 5:
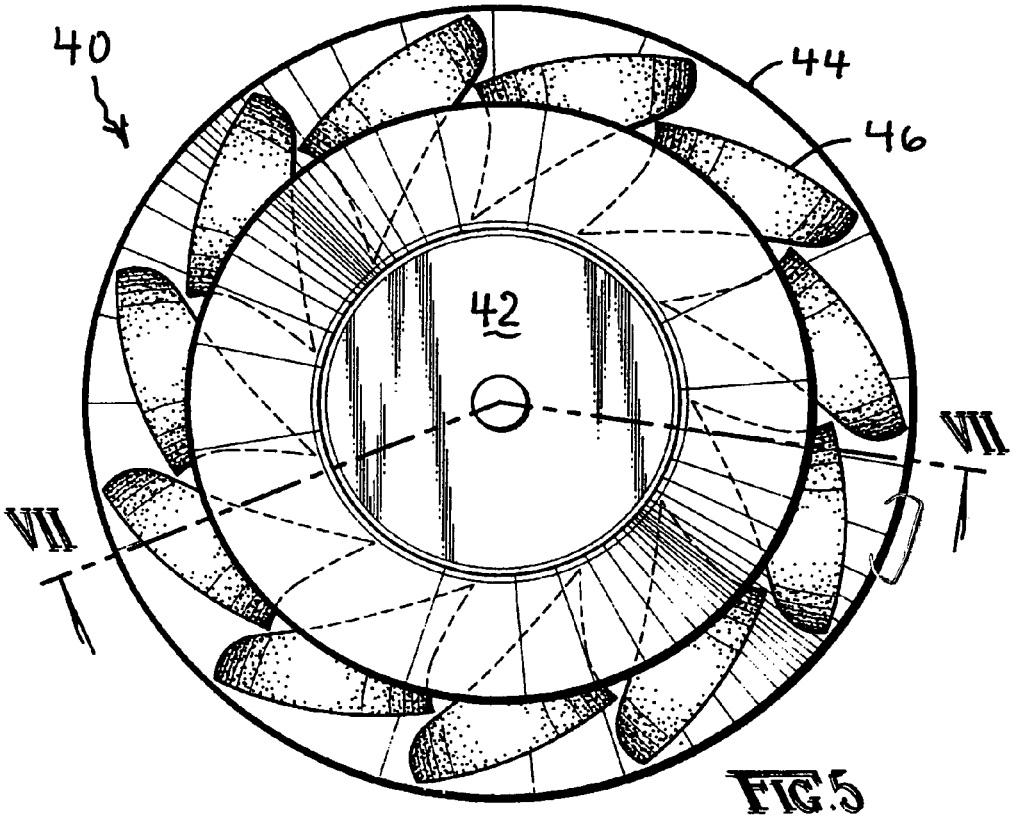
FIG. 5 is a top plan view thereof.

With reference to FIG. 4, the wheel 40 is designed to rotate in the clockwise direction. Hence the blades 46 can approximately be classified as a variety of backwardly curved blades. But only approximately, because the blades 46 have an inventive configuration all their own as will be more particularly described below. There are eleven (11) symmetrically-distributed blades 46 in this preferred embodiment of the wheel 40.

The blades 46 are all substantial copies of each other. For convenience of production, the blades 46 are formed into shape from flat sheet stock. However, it is believed it would be preferred better if the blades 46 were formed into airfoils (not illustrated). The hub 42, shroud 44 and blades 46 may all be produced out of a common metal—such as and without limitation aluminum or stainless steel—and then welded together into a solid unit to obtain the rigid wheel 40 as shown.

Each blade 46 has a pressure surface 50 opposite a suction surface 51 which are bounded by a hub edge 52, a shroud edge 54, a leading (intake-side) edge 56 and a trailing (outlet-side) edge 58. In determining a design for each blade 46, the warp of the surfaces 50 and 51 as well as the curvatures of the leading and trailing edges 56 and 58 are determined by aerodynamic and/or other performance considerations (eg., noise). The shapes of the hub and shroud edges 52 and 54 are determined by the necessity to conform with hub 42's and shroud 44's slant surfaces where they meet as shown.

Figure 8:
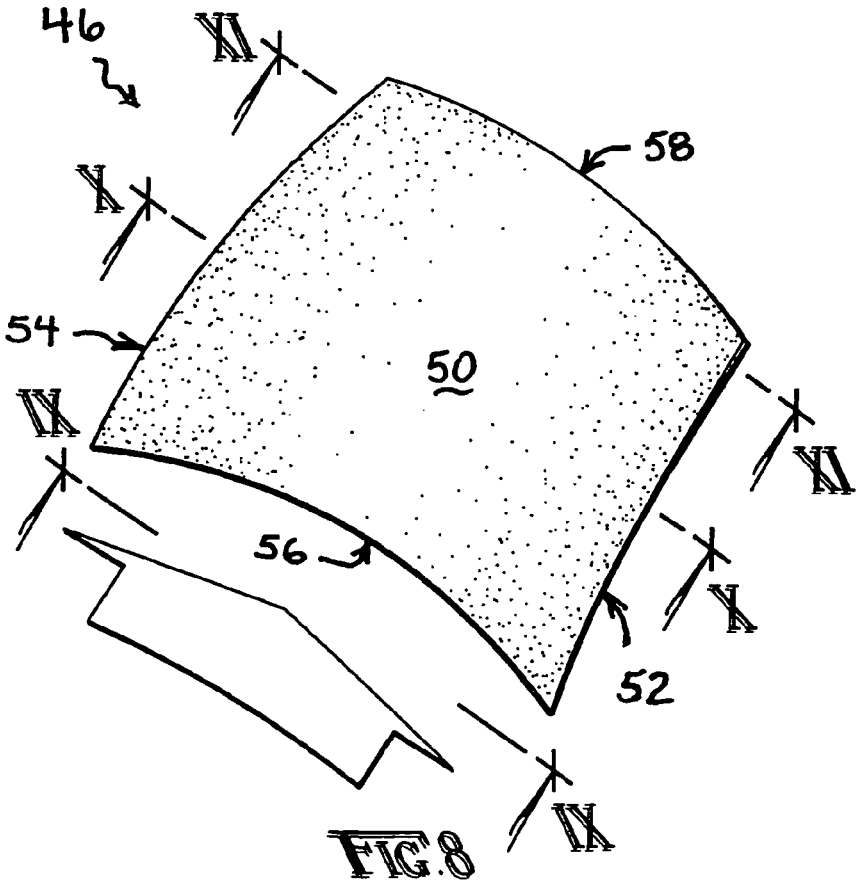
FIG. 8 is a blade plan view of the left blade in FIG. 7, and rotated clockwise from its orientation in FIG. 7 by about a quarter of a turn, it being typical of all the other blades of the wheel.

FIGS. 7 and 8 afford more convenient study of a single blade 46 in isolation from the cascade of others in the wheel 40. It is an aspect of the invention that the leading and/or trailing edges 56 and 58 are non-linear. The leading edge 56 is curved such that it recesses or arches into the center of geometry of the blade 46. Conversely, the trailing edge 58 is curved such that it bulges or arches outward from the center of geometry of the blade 46.

Figure 9:
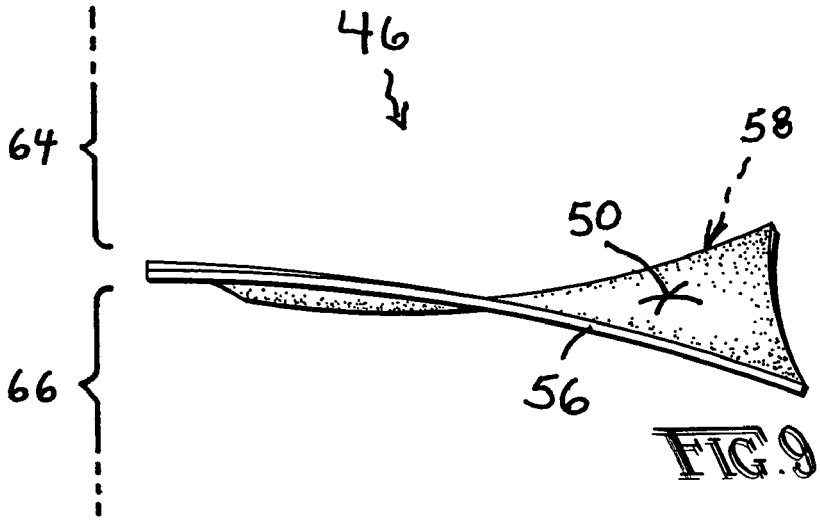
FIG. 9 is a blade elevational view taken in the direction of arrows IX-IX in FIG. 8.
Figure 10:
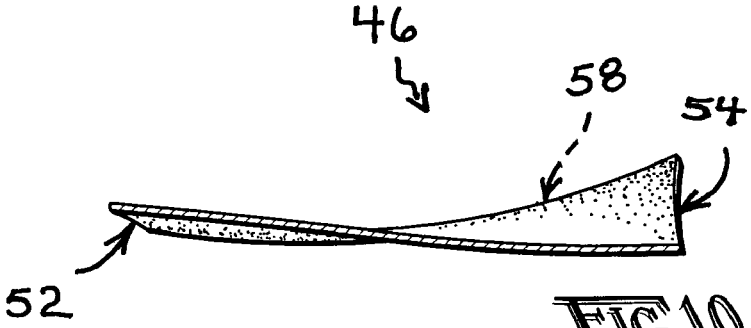
FIG. 10 is a sectional view taken along line X-X in FIG. 8.
Figure 11:
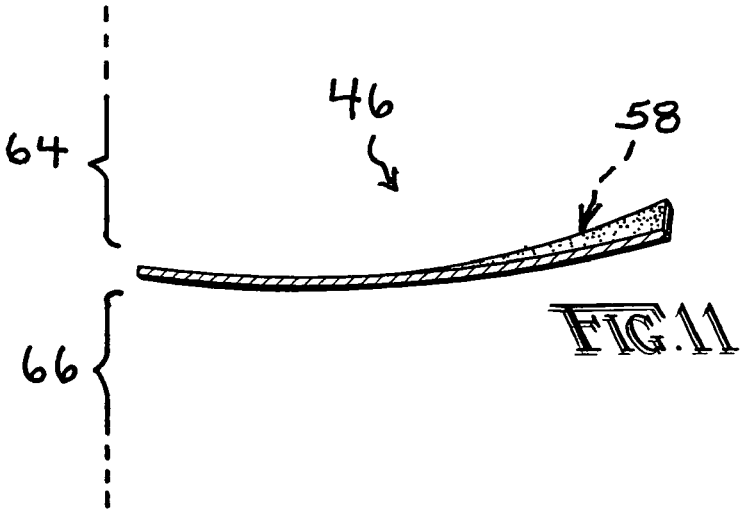
FIG. 11 is a sectional view taken along line XI-XI in FIG. 8.

FIGS. 9 through 11 are a series of three views contrasting the warp across the span of the blade between the hub and shroud edges 52 and 54 thereof at three locations along the body axis of the blade 46 (eg., the axis progressing from leading edge 56 to trailing edge 58). FIG. 9 shows best the warp in the span of the blade 46 at the leading edge 56. Consider that the blade 46 divides space into two spaces, pressure-side space 64 (which as the blade is oriented in FIG. 9 is above the blade) and suction-side space 66. Hence the warp in the span of the blade 46 at the leading edge 56 is convex into the pressure-side space 64.

The converse is true at the trailing edge 58 where, to skip ahead to FIG. 11, the warp in the span of the blade 46 at the trailing edge 58 is concave to the pressure-side space 66.

The leading and trailing edges 56 and 58 are not flipped images of each other. Among other ways that they are not, they are not in these two respects. In a minor respect, the warp-curvatures of their apparent arcs are not coincident. The trailing edge 58 is apparently a bit more tightly warped or curled. The other and more significant respect is described next in rather difficult terms. That is, their respective warp-curvatures circumscribe respective apparent centers which are not contained in a common plane of symmetry.

To put that differently, FIG. 9 shows that the leading edge 56's warp circumscribes an apparent center that would be down and left in the view. FIG. 11 shows that the trailing edge 58's warp circumscribes an apparent center that would be up and—not right but—left in the view. If the apparent centers were contained in a common plane symmetry, then the trailing edge 58's warp would (which it does not) circumscribe an apparent center which would be up and right at an equal angle of slant as the leading edge 56's apparent center that is down and left.

But the foregoing is not the case with the blade 46. Indeed, the apparent axes of symmetry for the blade 46 are corkscrewing counterclockwise in the progression along the body axis of the blade 46 from the leading to trailing edge 56 to 58. To put that differently, consider the following. FIG. 9 shows that the leading edge 56 might be reckoned as arranged about an apparent (eg., approximate) axis of symmetry that extends from the 1 o'clock position to the 7 o'clock position. In contrast, FIG. 11 shows that the trailing edge 58 might be reckoned as arranged about an apparent (eg., approximate) axis of symmetry that extends from the 11 o'clock position to the 5 o'clock position.

Hence any imaginary surface containing a procession of (apparent) axes of symmetry for the blade 46 in the procession along the body axis from leading to trailing edges 56 to 58 thereof would be a corkscrewing surface, originating in the 1 o'clock (to 7 o'clock) position and terminating in the 11 o'clock (to 5 o'clock) position.

FIG. 10 shows yet a further asymmetry with the warp of the blade 46. This one is involved. Consider the following. That is, the blade 46 could change from (i) being convex into pressure-side space 64 at the leading edge 56 to (ii) being concave to pressure-side space 64 at the trailing edge 58 by (iii) doing so 'symmetrically' about a corkscrewing surface of symmetry:—but apparently the blade 56 does not do this. FIG. 10 is cross-section of the about midway-span of the blade 46. The midway-span appears to contain an inflection point. That is, the hub-side half of the midway-span appears convex in pressure-side space 64 (eg., the left half of FIG. 10) while the shroud-side half appears concave to pressure-side space 64 (eg., the right half of FIG. 10). The change from convexity to concavity occurs at some intermediate inflection point, and FIG. 10 shows that the midway-span apparently contains such an inflection point.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

We claim:

1. A mixed flow fan wheel comprising:

a convex hub;

an axially-spaced away, concave annular shroud;

a plurality of angularly distributed blades extending between and interconnecting the hub and shroud, all which cooperatively define a plurality of inter-blade flow channels;

wherein each blade has a pressure surface and spaced suction surface extending not only between spaced leading and trailing edges but also, transversely thereto, spaced hub-side and shroud-side edges;

wherein the blades are arranged in backwardly-swept formations;

wherein each blade divides space into two spaces, pressure-side space interfacing the pressure surface and suction-side space interfacing the suction surface;

wherein both the leading edge and the trailing edge trace a respective span between the hub-side and shroud-side edges respectively; and wherein each blade is warped into the pressure- and suction-side spaces such that at least twenty-five percent (25%) of the leading edge's span is convex into pressure-side space and, conversely, at least twenty-five percent (25%) of the trailing edge's span is concave into pressure-side space.

2. The mixed flow fan wheel of claim 1 further comprising:

a fixed, annular convex diffuser formed with a central opening having an inner diameter sized for closely surrounding the hub's outer periphery.

3. The mixed flow fan wheel of claim 1 further comprising:

interchangeable upblast-configured and downblast configured windbands for interchangeable assembly with the mixed flow fan wheel and adapted to allow selection reversibly between an upblast-configured roof exhaust fan and a downblast-configured roof exhaust fan.

4. The mixed flow fan wheel of claim 1 wherein:

at least fifty percent (50%) of the leading edge's span is convex into pressure-side space.

5. The mixed flow fan wheel of claim 1 wherein:

at least fifty percent (50%) of the trailing edge's span is concave into pressure-side space.

6. The mixed flow fan wheel of claim 5 wherein:

at least fifty percent (50%) of the leading edge's span is convex into pressure-side space.

7. The mixed flow fan wheel of claim 1 wherein:

at least seventy-five percent (75%) of the leading edge's span is convex into pressure-side space.

8. The mixed flow fan wheel of claim 1 wherein:

at least seventy-five percent (75%) of the trailing edge's span is concave into pressure-side space.

9. The mixed flow fan wheel of claim 8 wherein:

at least seventy-five percent (75%) of the leading edge's span is convex into pressure-side space.

* * * * *